US007624812B2

(12) United States Patent
Pahila

(10) Patent No.: US 7,624,812 B2
(45) Date of Patent: Dec. 1, 2009

(54) EXTENDED COVERAGE, STORAGE, AUTOMATIC FIRE PROTECTION SPRINKLER

(75) Inventor: Oliver S. Pahila, Simpsonville, SC (US)

(73) Assignee: The Reliable Automatic Sprinkler Co., Mount Vernon, NY (US)

( * ) Notice: Subject to any disclaimer, the term of this patent is extended or adjusted under 35 U.S.C. 154(b) by 175 days.

(21) Appl. No.: 11/408,868

(22) Filed: Apr. 20, 2006

(65) Prior Publication Data

US 2007/0246232 A1 Oct. 25, 2007

(51) Int. Cl.
*A62C 37/08* (2006.01)
*A62C 37/12* (2006.01)
*B05B 1/26* (2006.01)

(52) U.S. Cl. ..... 169/37; 169/41; 169/57; 239/498; 239/504; 239/524

(58) Field of Classification Search ..... 169/37, 169/40, 41, 42, 57, 38, 39, 56, 59; 239/498, 239/504, 521, 522, 524, 494, 496
See application file for complete search history.

(56) References Cited

U.S. PATENT DOCUMENTS

| | | | | |
|---|---|---|---|---|
| 316,581 | A | 4/1885 | Stratton | 169/37 |
| 466,658 | A | 1/1892 | Cumnock et al. | |
| 733,646 | A | 7/1903 | Hibbard | |
| 720,013 | A | 10/1903 | Esty | |
| 776,614 | A | 6/1904 | Phelps | |
| 1,498,139 | A | 6/1924 | Williams | |
| 2,076,483 | A | 4/1937 | Rowley | |
| 2,135,138 | A | 11/1938 | Kendall | |
| 2,211,399 | A | 8/1940 | Winslow | |
| 2,389,333 | A | 11/1945 | Tyden | |
| 2,534,066 | A | 12/1950 | Rowley | |
| 2,697,008 | A | 12/1954 | Rowley | |
| 3,051,397 | A | 8/1962 | Hanson | |
| 3,346,051 | A | 10/1967 | Merdinyan | |
| 3,561,537 | A | 2/1971 | Bix | |

(Continued)

FOREIGN PATENT DOCUMENTS

| | | | |
|---|---|---|---|
| EP | 0759794 | B | 3/1997 |

(Continued)

OTHER PUBLICATIONS

"Viking ESFR Pendent K25.2 Sprinkler SIN VK510," The Viking Corporation, Hastings, Michigan, Jun. 10, 2005.

(Continued)

*Primary Examiner*—Len Tran
*Assistant Examiner*—Ryan Reis
(74) *Attorney, Agent, or Firm*—Fitzpatrick, Cella, Harper & Scinto

(57) ABSTRACT

A pendent fire protection sprinkler for storage applications, having a body including a fluid passage and an output orifice sealed with a seal cap, two arms extending from the body and meeting at a hub, a release mechanism with a thermally-responsive element positioned between the seal cap and the hub, and a deflector positioned on the hub and facing the output orifice. The deflector has aligned slots at about 90° from each other, corner slots located between the aligned slots, and angled slots located between the aligned slots and the corner slots.

29 Claims, 3 Drawing Sheets

U.S. PATENT DOCUMENTS

| | | | | | |
|---|---|---|---|---|---|
| 3,682,251 | A | | 8/1972 | Livingston | |
| 3,874,455 | A | | 4/1975 | Klesow | |
| 4,014,388 | A | | 3/1977 | Anderson | 169/37 |
| 4,091,873 | A | | 5/1978 | Werner | |
| 4,099,675 | A | | 7/1978 | Wohler et al. | 239/498 |
| 4,273,195 | A | | 6/1981 | Fischer et al. | |
| 4,296,815 | A | | 10/1981 | Mears | |
| 4,580,729 | A | | 4/1986 | Pounder | |
| 4,711,399 | A | | 12/1987 | Rosenberg | |
| 4,732,216 | A | | 3/1988 | Polan | |
| 4,757,865 | A | | 7/1988 | Simons | |
| 4,830,115 | A | | 5/1989 | Polan | |
| 4,923,013 | A | | 5/1990 | De Gennaro | |
| 5,020,601 | A | | 6/1991 | Retzloff et al. | |
| 5,072,792 | A | | 12/1991 | Simons et al. | |
| 5,152,344 | A | | 10/1992 | Fischer et al. | 169/37 |
| 5,203,416 | A | | 4/1993 | Takeuchi et al. | |
| 5,366,022 | A | | 11/1994 | Meyer et al. | 169/37 |
| 5,372,203 | A | | 12/1994 | Galaszewski | |
| 5,392,993 | A | | 2/1995 | Fischer | |
| 5,579,846 | A | | 12/1996 | Meyer et al. | |
| 5,584,344 | A | * | 12/1996 | Meyer et al. | 169/37 |
| 5,609,211 | A | | 3/1997 | Meyer et al. | |
| 5,632,339 | A | | 5/1997 | Fenske et al. | |
| 5,664,630 | A | | 9/1997 | Meyer et al. | |
| 5,687,914 | A | | 11/1997 | Bosio et al. | |
| 5,829,684 | A | | 11/1998 | Fischer | |
| 5,839,667 | A | | 11/1998 | Fischer | |
| 5,862,994 | A | | 1/1999 | Pounder et al. | |
| 5,865,256 | A | * | 2/1999 | Pounder | 169/37 |
| 5,890,657 | A | * | 4/1999 | Ponte | 239/518 |
| 5,915,479 | A | | 6/1999 | Ponte | 169/46 |
| 6,026,907 | A | | 2/2000 | Pahila | |
| 6,059,044 | A | | 5/2000 | Fischer | |
| 6,098,718 | A | | 8/2000 | Sato | 169/37 |
| 6,276,460 | B1 | * | 8/2001 | Pahila | 169/37 |
| 6,446,732 | B1 | | 9/2002 | Polan | |
| 6,450,266 | B1 | | 9/2002 | Pahila | 169/37 |
| 6,502,643 | B1 | * | 1/2003 | Meyer et al. | 169/37 |
| 6,516,893 | B2 | * | 2/2003 | Pahila | 169/37 |
| 6,799,639 | B2 | | 10/2004 | Sato et al. | 169/37 |
| 7,343,980 | B2 | | 3/2008 | Pahila | 169/37 |
| 2002/0096580 | A1 | | 7/2002 | Pahila | 239/498 |
| 2003/0111237 | A1 | | 6/2003 | Sato et al. | 169/37 |
| 2005/0035022 | A1 | | 2/2005 | Ide et al. | |
| 2005/0178564 | A1 | | 8/2005 | Orr | 169/37 |

FOREIGN PATENT DOCUMENTS

| | | |
|---|---|---|
| EP | 0898984 | 3/1999 |
| GB | 1412348 | 11/1975 |
| GB | 2049415 | 12/1980 |
| GB | 2333702 | 8/1999 |
| GB | 2337199 | 6/2002 |
| JP | 2001046544 | 2/2001 |
| WO | 01/54772 | 8/2001 |
| WO | 01/64289 | 9/2001 |

OTHER PUBLICATIONS

Pendent Sprinkler has 25.2 K-factor. Apr. 9, 2003, http://news.thomasnet.com/fullstory/21191.

"Ordinary Hazard Group 3 Protection Using Enhanced Protection Extended Coverage Sprinklers," Technical Bulletin 222:2004:1.

"Sprinkler Protection of Concealed Spaces in OH3 EPEC Sprinklered Buildings," Technical Bulletin 223:2004:1.

Newsletter No. 19, British Automatic Sprinkler Association Limited, Mar. 2005.

"Introduction of the new EPEC sprinkler," Tyco Building Services Products, http://www.tycobuilding.com/cgi-bin/webscripts/nph-news.pl?id=1537.

"Launch Package EPEC Sprinkler," http://www.tycobuilding.com/user/PDF/FireProtection/EPEC_Launch_Internet.pdf.

* cited by examiner

EXTENDED COVERAGE, STORAGE, AUTOMATIC FIRE PROTECTION SPRINKLER

BACKGROUND OF THE INVENTION

1. Field of the Invention

The present invention relates to an automatic fire protection sprinkler, and in particular an extended coverage, storage sprinkler, designed in accordance with density/area criteria.

2. Related Art

Fire protection sprinklers conventionally are connected to a conduit to receive pressurized fire-extinguishing fluid, such as water. A typical sprinkler has a base with a threaded portion for connection to the conduit and an output orifice to output the fluid to provide fire control and/or suppression. The output orifice is sealed by a seal cap, which is held in place by a release mechanism. The release mechanism is designed to release the cap under predetermined conditions, thereby initiating the flow of fire-extinguishing fluid. A typical release mechanism includes a thermally-responsive element, e.g., a frangible bulb or fusible link, and may also include a latching mechanism.

Certain conventional sprinklers have a pair of arms that extend from the base portion and meet at a hub portion to form a frame. The hub portion is spaced apart from the output orifice of the base portion and is aligned with a longitudinal axis thereof. The hub portion may have a set-screw configured to apply a pre-tension force to the release mechanism. A deflector may be mounted on the hub, transverse to the output orifice, to provide dispersion of the output fluid.

Fire protection sprinklers may be mounted on a fluid conduit running along a ceiling and may either depend downward from the conduit, which is referred to as a "pendent" configuration, or may extend upward, which is referred to as an "upright" configuration. Alternatively, a sprinkler may be mounted on a wall, a certain distance below the ceiling, which is referred to as a "horizontal sidewall" configuration. Horizontal sidewall sprinklers have an output orifice that is oriented so that the fluid is output horizontally and sprays onto an area to be protected in front of the sprinkler.

An "extended coverage storage sprinkler (density/area)," as described in Section 5.11 of UL 199 ("Standard for Automatic Sprinklers for Fire-Protection Service," Underwriters' Laboratories, $11^{th}$ Ed., Nov. 4, 2005) is a sprinkler that is intended to be installed using the extended coverage area (e.g., 14 ft by 14 ft) and density/area criteria specified in NFPA 13 ("Standard for the Installation of Sprinkler Systems," National Fire Protection Association, Inc., 2002 Edition). These sprinklers incorporate a heat responsive element and release mechanism that has a response time equal to or less than a standard response sprinkler used on sprinklers designed for standard spacings (e.g., 12 ft by 12 ft).

NFPA 13 defines a number of different types of storage sprinklers. Section 12.7.2, for example, provides "Sprinkler Design Criteria for Storage and Display of Class I through Class IV Commodities, Cartoned Non-Expanded Group A Plastics, and Non-Expanded Exposed Group A Plastics in Retail Stores." In such applications, the sprinkler must be connected to a wet pipe system designed to meet two separate design points: 0.6 gpm/$ft^2$ density over 2000 $ft^2$ and 0.7 gpm/$ft^2$ density for the four hydraulically most demanding sprinklers (e.g., the four sprinklers furthest from the source). Systems meeting these density/area criteria are permitted for use in protecting single and double-row slatted shelf racks using an extended coverage sprinkler with a nominal K-factor of 25.2 listed for storage occupancies.

SUMMARY OF THE INVENTION

In one aspect, the present invention provides a pendent fire protection sprinkler, including a deflector having a first pair of opposed slots, a second pair of opposed slots at about 90° from the first pair of slots, a third pair of opposed slots, positioned between both the first and second pairs of opposed slots, and a plurality of angled slots, positioned between the first and third pairs of opposed slots and the second and third pairs of opposed slots.

Embodiments of the present invention may include one or more of the following features.

The deflector may be a planar, circular disk having a radius of about 1.6-2.1 inches. The first and second pairs of opposed slots may have a radial length of about 0.4-0.5 inches. The third pair of opposed slots may have a radial length of about 0.5-0.7 inches. The angled slots may have a radial length of about 0.15-0.20 inches.

The first and second pairs of slots may have a radial length of about 20-30% of a radius of the deflector. The third pair of opposed slots may have a radial length of about 28-38% of a radius of the deflector. The angled slots may have a radial length of about 7-12% of a radius of the deflector.

A center line of the angled slots may form an angle of about 20-50° with respect to a radial line extending from a center of the deflector through inner ends of the angled slots. The inner ends of the angled slots may be positioned about 15-30° from the nearest slot of the first and second pairs of slots. The third pair of opposed slots may form an angle of about 40-50° with the first and second pairs of slots.

The sprinkler may achieve a water discharge density of 0.6 gpm/$ft^2$ density over an area of 2000 $ft^2$, and the nominal K-factor may be 25.2.

In another aspect, the present invention provides a pendent fire protection sprinkler for storage applications, having a body including a fluid passage and an output orifice sealed with a seal cap, two arms extending from the body and meeting at a hub, a release mechanism with a thermally-responsive element positioned between the seal cap and the hub, and a deflector positioned on the hub and facing the output orifice. The deflector includes a plurality of aligned slots at about 90° from each other, a plurality of corner slots located between the aligned slots, and a plurality of angled slots located between the aligned slots and the corner slots.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

DETAILED DESCRIPTION OF THE PREFERRED EMBODIMENTS

Figure 1:
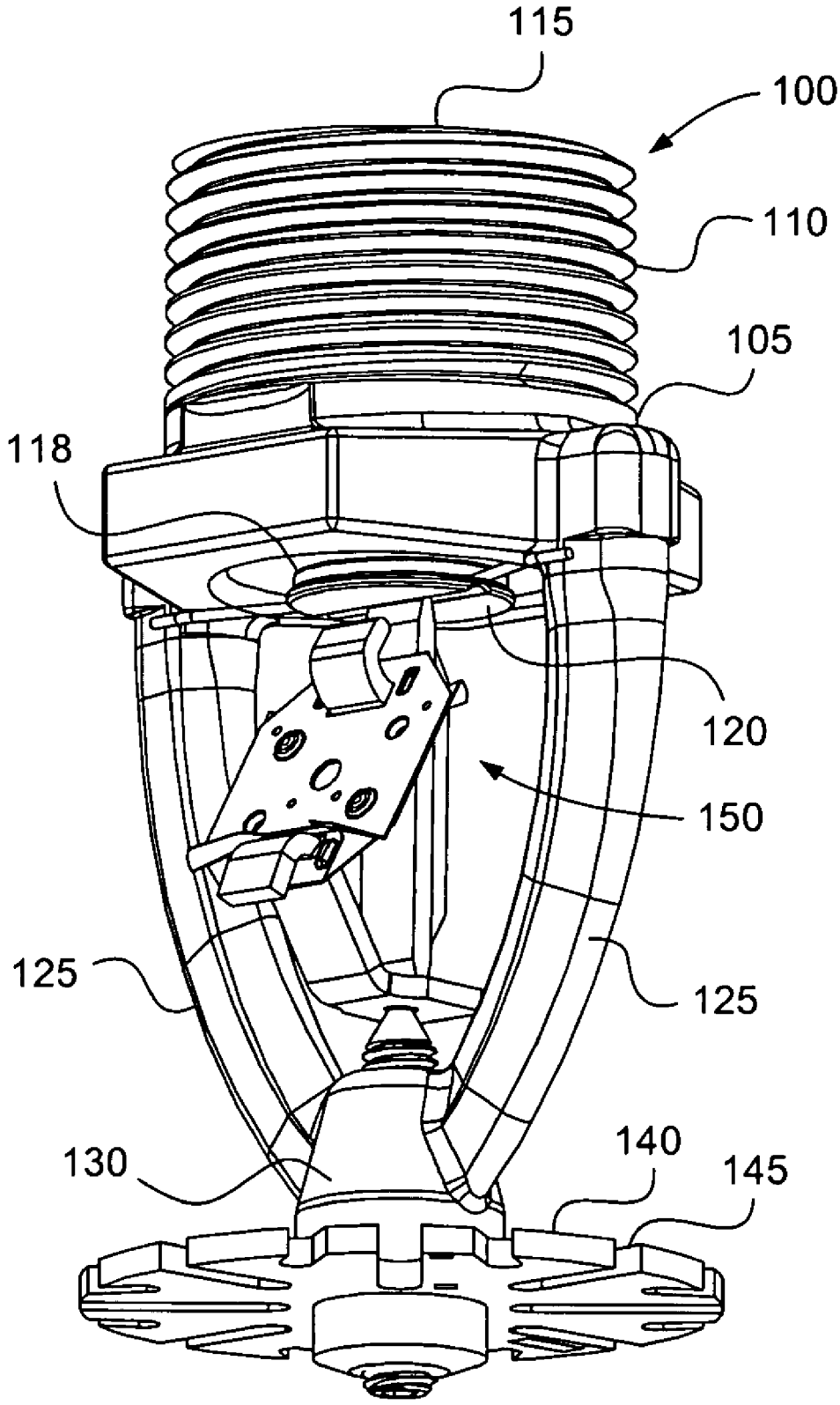
FIG. 1 is a perspective view of the pendent sprinkler in accordance with the present invention.

FIG. 1 shows a pendent sprinkler 100, in accordance with the present invention, having a body 105 defining an axial fluid passage. The top of the body has a threaded portion 110 on its outer surface to allow the sprinkler to be connected to a conduit (not shown) for providing pressurized fire-extinguishing fluid, such as water, to an input end 115 of the fluid passage. The fluid passage has an output orifice 118 at the opposite end that is sealed by a seal cap 120. The input end 115 may have a diameter of, for example, 1 inch NPT (national pipe thread). The sprinkler may have a K-factor of, for example, 25.2, which is defined by $K=Q/\sqrt{p}$, where Q is the flow rate in gallons per minute and p is the residual pressure at the inlet of the sprinkler in pounds per square inch.

Two frame arms 125 extend from the lower portion of the body 105 and meet at a hub 130 positioned below and in axial alignment with the output orifice 118. A deflector 140 is positioned on the hub 130 so as to be impinged by the output fluid upon activation of the sprinkler 100. As further discussed below, the deflector 140 in this particular embodiment is a circular, planar disk that is centered on and orthogonal to the axis of the fluid passage. The disk has a number of slots 145 of varying length and orientation arrayed around its periphery.

A release mechanism, e.g., a fusible link assembly 150, having a thermally-responsive element, e.g., a fusible link 235, is positioned between the hub 130 and the seal cap 120 to hold the seal cap in place over the output orifice 118. As shown in the sectional view of FIG. 2, the link assembly 150 includes a lever 205 positioned on a set screw 210 that extends upward from the hub 130. A strut 215 is positioned between the seal cap 120 and the lever 205, such that one end of the strut 215 is positioned in a slot 220 on the surface of the seal cap 120 and the other end of is positioned in a slot 225 on the lever, slightly offset from the set screw 210.

Figure 2:
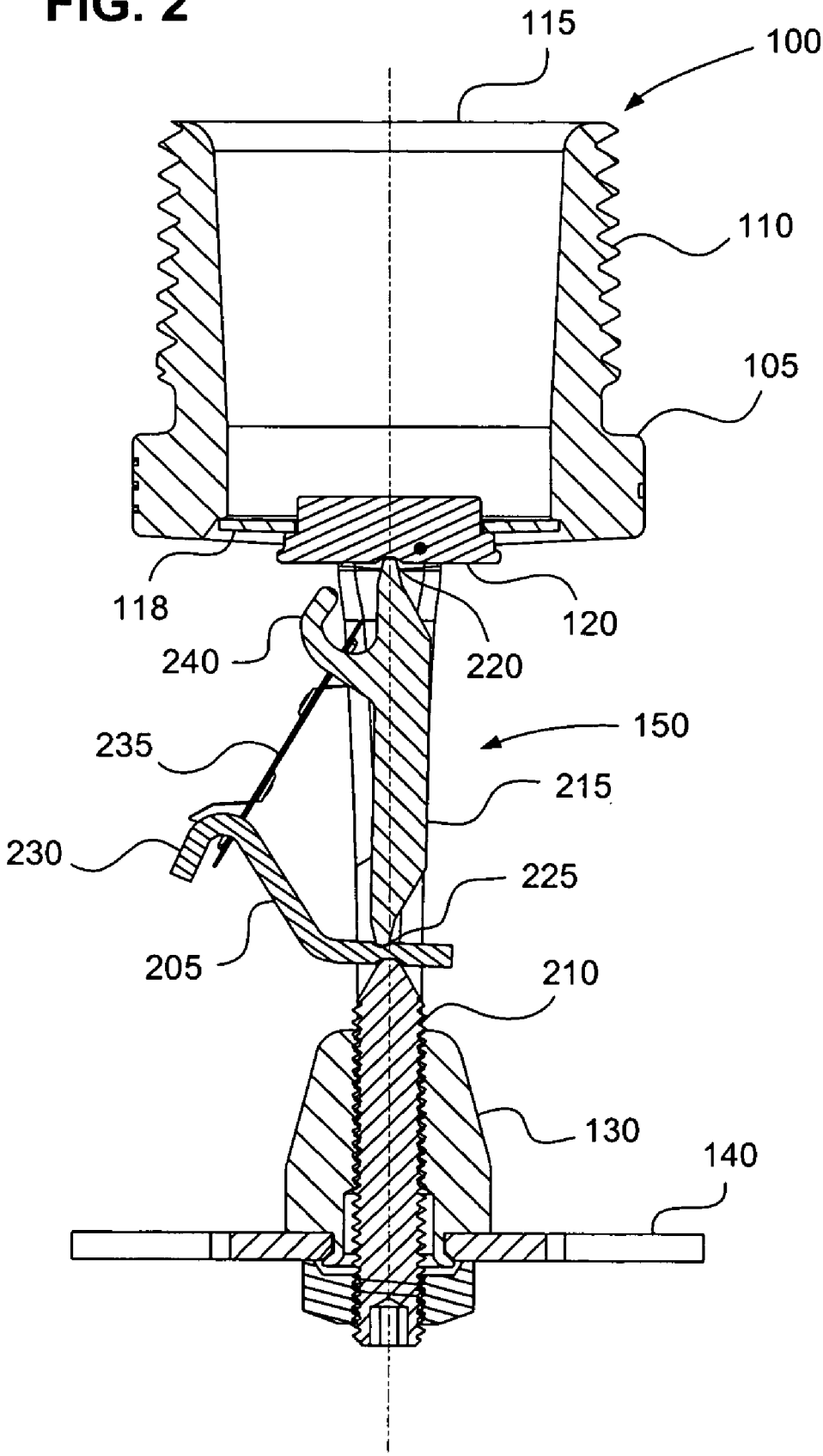
FIG. 2 is a sectional view of the pendent sprinkler in a plane perpendicular to the plane of the frame arms.

The pressure of the fluid on the seal cap 120 causes a downward force on the strut 215, which in turn causes the extended end 230 of the lever 205 to tend to rotate away from the strut 215 (i.e., the lever 205 rotates counter-clockwise in the view of FIG. 2). The rotational force on the lever 205 creates a tension force on the fusible link 235, which is attached between the extended end 230 of the lever 205 and a hook 240 on the upper portion of the strut 215.

The fusible link 235 comprises two thin, metal plates, e.g., beryllium-nickel alloy, one connected to the lever 205 and the other connected to the strut 215. The plates are joined in an overlapping manner with solder that melts at a predetermined temperature. The link 235 separates at the predetermined temperature, due to the tension force applied by the lever 205 and the strut 215, allowing the lever 205 and the strut 215 to swing outward. This in turn releases the seal cap 120 and allows the fluid to be output from the orifice 118. Of course, other types of release mechanisms may be used, including, but not limited to, for example, a frangible bulb or a sensor, strut, and lever assembly.

Figure 3:
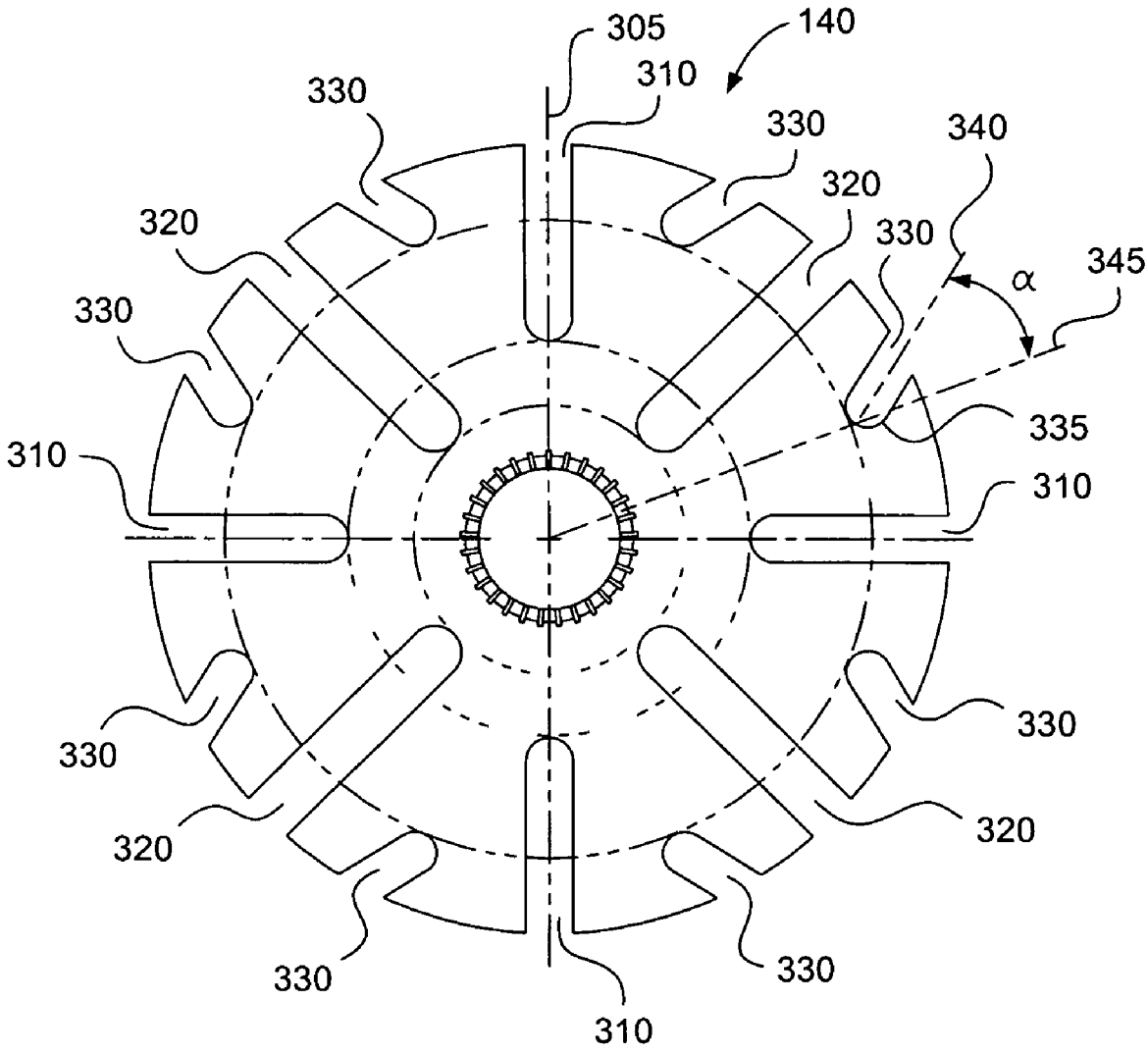
FIG. 3 is a plan view of the deflector showing the surface that faces away from the outlet orifice.

FIG. 3 shows an embodiment of the deflector 140, which as noted above, is a circular, planar disk having a number of slots of varying length and orientation arrayed around its periphery. The deflector 140 may be formed, for example, of phosphor bronze and may have a radius of about 1.85 inches and a thickness of about 0.08 inches. The deflector 140 may be planar, as shown in this embodiment, or may be curved or bent, so that an outer portion of the deflector 140 extends away from the outlet orifice 118.

The positions of the slots may be described in terms of the approximate angle between each slot and a reference line 305 extending vertically though the planar view of the disk in FIG. 3. In the exemplary embodiment, there is a set of four slots 310 in a perpendicular configuration ("the aligned slots"), each having a radial length of about 0.46 inches (which is about 25% of the deflector radius) and a width of about 0.11 inches. In alternative embodiments, the length of these slots may be vary by about ±15%.

There is also a set four slots 320 at 45° from the reference line 305, each having a radial length of about 0.61 inches (about 33% of the deflector radius) and a width of about 0.125 inches (the "corner slots"). In alternative embodiments, the length of these slots may be vary by about ±15%.

There is also a set of eight slots 330 ("the angled slots") that are oriented to form an angle ($\alpha$) of about 35° between center lines 340 of the angled slots 330 and radial lines 345 passing through inner ends 335 of the angled slots 330 (i.e., passing through the origin of the radius of the inner end). In alternative embodiments, the angle $\alpha$ may vary between about 20-50°. The angled slots have a radial length (i.e., the distance from the inner end to the outside edge of the deflector along the radial line 345) of about 0.175 inches (about 9% of the deflector radius) and a width of about 0.1 inches. In alternative embodiments, the length of these slots may be vary by about ±15%. The inner ends 335 of the angled slots 330 are positioned about midway between the aligned slots 310 and the corner slots 320, i.e., the angled slots 330 are at about 22.5° or at about 67.5° from the reference line.

The slots discussed above have rounded inner ends that are approximately semicircular, with a radius equal to half the slot width, but other geometries may also be used. Of course, the deflector may have other slots in addition to those described above.

In accordance with UL 199, storage, area/density sprinklers are tested in a large scale fire test, in which an array of sprinklers is installed over predetermined configurations of commodities, e.g., a double-row rack of standard, cartoned Group A plastic commodities, beneath a smooth, flat, non-combustible ceiling. The water flow from the sprinklers must be controlled by the deflector to achieve an output pattern that meets the required water discharge density specified for the sprinkler. Representative sample sprinklers are installed at a specified spacing for each fire test, which is 14 ft for K-25.2 extended coverage sprinklers. The ignition point for the fire test is positioned either beneath a single sprinkler, between two sprinklers on the same branch line, or in the center of four sprinklers (i.e., at the center of a square 14 ft on each side).

In order to maintain the proper density of water output over the specified area, the sprinkler 100 must have a spray pattern that is approximately square. Thus, the sprinkler 100 must be configured to throw water farther in the direction of the corner slots 320 (45° from the reference line 305), relative to the aligned slots 310 (0° and 90° from the reference line 305). This is particularly so for the test in which the ignition point is centered between four sprinklers, because the ignition point will be aligned with the corner slots 320 of each of the four sprinklers (i.e., in the corner of the approximately square pattern of each sprinkler).

To achieve the approximately square output pattern, the corner slots 320 are designed to be somewhat longer than the aligned slots 310, in order to project more water toward the corners of the spray pattern. Likewise, the angled slots 330 are angled toward the corners of the output pattern, which further tends to create a square pattern. In addition, directing the output spray toward the corners of the spray pattern lessens the amount of water output toward adjacent sprinklers. This helps prevent "cold soldering," which is a condition in which water is output by a sprinkler directly onto an adjacent sprinkler, thereby lowering the temperature of the adjacent sprinkler and preventing it from properly activating.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A pendent fire protection sprinkler, comprising a deflector having:

a first pair of opposed slots, a second pair of opposed slots at about 90° from the first pair of slots, a third pair of opposed slots, positioned between both the first and second pairs of opposed slots, and a plurality of angled slots, positioned between the first and third pairs of opposed slots and the second and third pairs of opposed slots, wherein a centerline of each angled slot extends outwardly in a direction toward a centerline of an adjacent one of the third pair of opposed slots that extends outwardly.

2. The pendent fire protection sprinkler of claim 1, wherein the sprinkler achieves a water discharge density of 0.6 gpm/$ft^2$ density over an area of 2000 $ft^2$.

3. The pendent fire protection sprinkler of claim 1, wherein the deflector comprises a planar, circular disk.

4. The pendent fire protection sprinkler of claim 1, wherein the deflector has a radius of about 1.6-2.1 inches.

5. The pendent fire protection sprinkler of claim 4, wherein the first and second pairs of opposed slots have a radial length of about 0.4-0.5 inches.

6. The pendent fire protection sprinkler of claim 4, wherein the third pair of opposed slots have a radial length of about 0.5-0.7 inches.

7. The pendent fire protection sprinkler of claim 4, wherein the angled slots have a radial length of about 0.15-0.20 inches.

8. The pendent fire protection sprinkler of claim 1, wherein the first and second pairs of slots have a radial length of about 20-30% of a radius of the deflector.

9. The pendent fire protection sprinkler of claim 1, wherein the angled slots have a radial length of about 7-12% of a radius of the deflector.

10. The pendent fire protection sprinkler of claim 1, wherein a center line of the angled slots form an angle of about 20-50° with respect to a radial line extending from a center of the deflector through inner ends of the angled slots.

11. The pendent fire protection sprinkler of claim 1, wherein the inner ends of the angled slots are positioned about 15-30° from the nearest slot of the first and second pairs of slots.

12. The pendent fire protection sprinkler of claim 1, wherein the third pair of opposed slots form an angle of about 40-50° with the first and second pairs of slots.

13. The pendent fire protection sprinkler of claim 1, wherein the third pair of opposed slots have a radial length of about 28-38% of a radius of the deflector.

14. The pendent fire protection sprinkler of claim 1, wherein the nominal K-factor of the sprinkler is 25.2.

15. A pendent fire protection sprinkler for storage applications, comprising a body including a fluid passage and an output orifice sealed with a seal cap, two arms extending from the body and meeting at a hub, a release mechanism with a thermally-responsive element positioned between the seal cap and the hub, and a deflector positioned on the hub and facing the output orifice, the deflector comprising:

a plurality of aligned slots at about 90° from each other;

a plurality of corner slots located between the aligned slots; and a plurality of angled slots located between the aligned slots and the corner slots, wherein a centerline of each angled slot extends outwardly in a direction toward a centerline extending outwardly from an adjacent corner slot.

16. The pendent fire protection sprinkler of claim 15, wherein the aligned slots are parallel to or perpendicular to a plane of the arms.

17. The pendent fire protection sprinkler of claim 15, wherein the sprinkler achieves a water discharge density of 0.6 gpm/$ft^2$ density over an area of 2000 $ft^2$.

18. The pendent fire protection sprinkler of claim 15, wherein the deflector comprises a planar, circular disk.

19. The pendent fire protection sprinkler of claim 15, wherein the deflector has a radius of about 1.6-2.1 inches.

20. The pendent fire protection sprinkler of claim 19, wherein the first and second pairs of opposed slots have a radial length of about 0.4-0.5 inches.

21. The pendent fire protection sprinkler of claim 19, wherein the corner slots have a radial length of about 0.5-0.7 inches.

22. The pendent fire protection sprinkler of claim 19, wherein the angled slots have a radial length of about 0.15-0.20 inches.

23. The pendent fire protection sprinkler of claim 15, wherein the aligned slots have a radial length of about 20-30% of a radius of the deflector.

24. The pendent fire protection sprinkler of claim 15 wherein the angled slots have a radial length of about 7-12% of a radius of the deflector.

25. The pendent fire protection sprinkler of claim 15, wherein a center line of the angled slots form an angle of about 20-50° with respect to a radial line extending from a center of the deflector through inner ends of the angled slots.

26. The pendent fire protection sprinkler of claim 15, wherein the inner ends of the angled slots are positioned about 15-30° from the nearest slot of the first and second pairs of slots.

27. The pendent fire protection sprinkler of claim 15, wherein the corner slots form an angle of about 40-50° with the aligned slots.

28. The pendent fire protection sprinkler of claim 15, wherein the corner slots have a radial length of about 28-38% of a radius of the deflector.

29. The pendent fire protection sprinkler of claim 15, wherein the nominal K-factor of the sprinkler is 25.2.

* * * * *